United States Patent [19]

Minor et al.

[11] Patent Number: 5,017,042

[45] Date of Patent: May 21, 1991

[54] FLUID DIRECTING SYSTEMS

[76] Inventors: Robert N. Minor; Kjell E. Berg, both of 51 Springfield Rd., Stafford Springs, Conn. 06076

[21] Appl. No.: 451,317

[22] Filed: Dec. 15, 1989

[51] Int. Cl.[5] ..... E02B 11/00; E02B 13/00

[52] U.S. Cl. ..... 405/50; 52/169.5; 405/36; 405/43; 405/45

[58] Field of Search ..... 405/36, 43–48, 405/50; 52/169.5; 210/DIG. 6, DIG. 7, 283, 532.2

[56] References Cited

U.S. PATENT DOCUMENTS

| | | | |
|---|---|---|---|
| 3,441,140 | 4/1969 | Thurber | 405/50 X |
| 4,288,321 | 9/1981 | Beane | 405/45 X |
| 4,319,998 | 3/1982 | Anderson | 210/532.2 X |
| 4,614,584 | 9/1986 | Di Duca | 210/532.2 X |

FOREIGN PATENT DOCUMENTS

| | | | |
|---|---|---|---|
| 2551267 | 5/1977 | Fed. Rep. of Germany | 405/45 |
| 478962 | 11/1969 | Switzerland | 405/45 |
| 1420109 | 8/1988 | U.S.S.R. | 405/43 |

*Primary Examiner*—Dennis L. Taylor

*Attorney, Agent, or Firm*—Chilton, Alix & Van Kirk

[57] ABSTRACT

Collapsible cellular arrays constructed of biodegradable material are employed to define liquid flow courses in a subterranean environment. The cellular arrays receive and support, in a desired orientation and position, liquid delivery/removal conduits. The cells of the arrays are preferrable hexagonal in shape and are filled with a particulate filter material.

18 Claims, 4 Drawing Sheets

FLUID DIRECTING SYSTEMS

BACKGROUND OF THE INVENTION

1. Field of the Invention

The present invention relates to the exercise of control over the flow of fluid without confining the fluid to a conduit and particularly to directing the flow of water in a subterranean environment. More specifically, this invention is directed to apparatus which facilitates the construction of subdrains, leach fields and filter beds and especially to cellular forms which facilitate the construction of such drains, fields and beds. Accordingly, the general objects of the present invention are to provide novel and improved methods and apparatus of such character.

2. Decription of the Prior Art

While not limited thereto in its utility, the present invention is particularly useful in and as underground fluid distribution systems. In recent years, because of the increasing awareness of the need to protect the environment against contamination by pollutants and to prevent silting of waterways, municipalities have adopted regulations which have significantly increased the cost of constructing various types of subterranean drain systems. A desire has, accordingly, developed for techniques and apparatus which will permit the construction of code conforming drainage systems which require less labor and less raw material such as, for example, crushed stone.

For a discussion of prior methods and apparatus for underground water distribution, reference may be had to U.S. Pat. Nos. 3,563,038, 4,330,222, 4,538,386, 4,806,043. The teachings of these prior patent are not directed to solving the problems of establishing effective and reliable drainage systems in an economical manner.

SUMMARY OF THE INVENTION

The present invention overcomes above-briefly discussed and other deficiencies of the prior art by providing a novel technique for constructing subterranean drains and the like. The invention also encompasses unique apparatus for use in such techniques and particularly light-weight, collapsible, cellular forms which may be employed to define the paths which the fluid to be controlled will follow in, for example, flowing from a first location to a desired second location. The forms in accordance with the present invention are preferably fabricated from a biodegradable material, corrugated cardboard for example, which may be treated in a manner commensurate with the intended application. The material from which the forms are fabricated is configured such that it may assume a flat shape for transportation and storage and an open cellular, preferrably hexagonal, shape when in use. The form material will typically be provided as a module which comprises an array of adjacent cells which can, by any suitable means, be connected to other such modules to define a flow path of any desired length. The cell arrays have sufficient flexibility to allow for installation in, for example, a curved configuration.

BRIEF DESCRIPTION OF THE DRAWING

The present invention may be better understood, and its numerous objects and advantages will become apparent to those skilled in the art, by reference to the accompanying drawing wherein like reference numerals refer to like elements in the several figures and in which.

DECRIPTION OF THE DISCLOSED EMBODIMENTS

The present invention is based upon a use of individual cells which, in accordance with the preferred embodiment, are collapsable in the interest in minimizing shipping and storage space. These cells are also preferable of hexagonal shape and defined by material which, in its untreated state, is biodegradable. The dimensions and configuration of the individual cells will vary depending upon the intended usage. Similarly, the stiffness, density and other physical properties of the material from which the cells are fabricated will be varied in accordance with the dictates of the end use. In the disclosed embodiments the cells are interconnected to define serial arrays and the arrays can be interconnected to form a fluid directing channel of the desired or requisite length and configuration.

Figure 1:
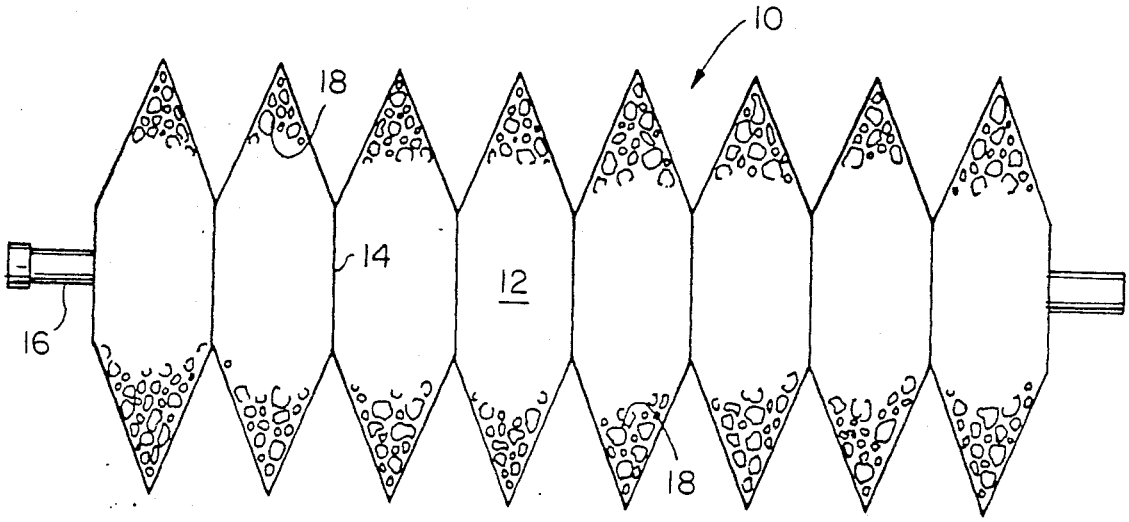
FIG. 1 is a top view of a portion of a leach field fabricated employing the teachings of the present invention.
Figure 2:
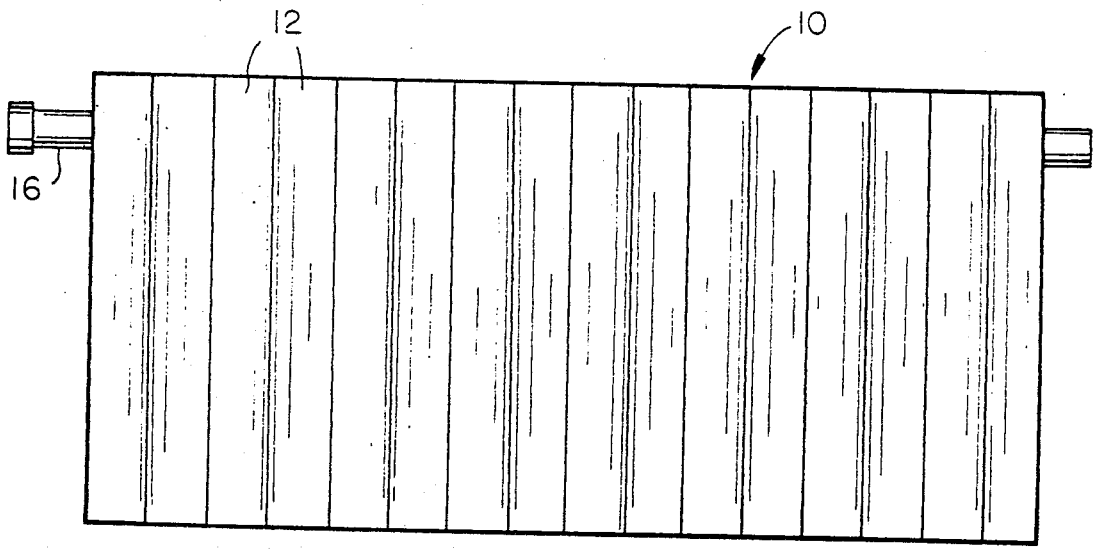
FIG. 2 is a side view of the apparatus of FIG. 1.

With reference now to the drawing, and particularly FIGS. 1 and 2, the present invention enables the defining of a leach field of a sewage disposal system. When compared to the prior art, this leach field has, for a given length, significantly increased fluid transfer surface area which contacts the native backfill. FIGS. 1 and 2 show an abbreviated leg of a leach field respectively in a cross-sectional top view and a side elevation view. The field leg, which is indicated generally at 10, comprises by a cell unit or array 11 which is defined by plural, interconnected, hexagonal shaped individual cells 12. The array of cells 12 which define field 10 is fabricated from a fluid pervious, biodegradable material such as, for example, corrugated cardboard. In accordance with one reduction to practice, an elongated sheet of cardboard was treated, for example by scribing or crushing, to define pre-manufactured joints, the treated sheet defining the exterior of the array. The sheet was closed on itself, typically by an overlapping stapled or sewed joint, in one of the straight portions thereof. The panels 14, which subdivide the array into the individual cells 12, are inserted as shown and affixed to the sheet material by any suitable means, through the use of adhesive or a biodegradable paper tape for example. The resultant product may be collapsed in accordian-like fashion for shipment and storage.

The divider panels 14, and the sheet material which defines the exterior of the array at the two opposing ends thereof, are provided with aligned openings which are sized to tightly receive a perforated leachate carrying pipe 16. As may be seen from FIG. 2, in the leach field application the holes which receive the pipe 16 are located near the top of the array. The holes which receive pipe 16 may also be provided at slightly different levels in each of the panels 14 so as to impart a desired pitch to pipe 16. As an alternative, which would be employed where pipe 16 is of flexible corrugated construction rather than having a constant outer diameter, each of the panels 14 can be constructed with a removable tapered knockout which defines an opening extending from either the top or bottom of the array so that the pipe 16 can be installed by forcing it into the tapered opening from the side of the array to which the tapered opening extends.

In the leach field application, presuming that the trench has been dug, the array of cells 12 will be positioned in the trench and unfolded to the open condition depicted in FIGS. 1 and 2. It will be understood, of course, that a single leg of a leach field may be defined by a series of the arrays which may be in abutting relationship. After erection in the trench, and presuming that the holes in the divider panels 14 will impart the desired pitch to the pipe 16, the installer need only insure, for example by placing a level across the top of the array, that the array is level. Thereafter, the pipe 16 will be installed, the individual cells 12 will be filled with stone or aggregate filler 18 and the trench then backfilled.

In use, the pipe 16 acts to carry leachate liquids into the cellular system, the liquids being distributed throughout the length of the field leg. The liquids will percolate through the fill material 18, which thus acts as a filter, while being aerated, and thus will permeate outwardly through the stone or aggregate and into the soil through the array defining sheet material/soil interface. The sheet material, i.e., the fluid permeable cardboard in the disclosed embodiment, surrounds the stone or aggregate filter on the sides and, most importantly, promotes the formation of a biological mat as is critical in renovating the leachate. The sheet material, when used in conjunction with a geotextile filter material installed in the trench under the sell array, also acts to protect the biological mat from failure thus reducing the likelihood of concentrated mat break-throughs which would result in the formation of saturated zones beneath the leach field. When such saturated zones occur, unrenovated leachate liquids may reach water courses and result in the pollution thereof. It is to be understood that the sheet material can be perforated to enhance its permeability.

As will be obvious to those skilled in the art from the above discussion, the cellular system of the present invention enables economical, controlled and proper placement of a leachate distribution pipe and stone or other aggregate filler and aeration material and, in so doing, maximizes the efficiency of exfiltration of liquids. This maximization of exfiltration efficiency results from the geometric shape of the individual cells which increases the effective filter material/soil interface area. Simultaneously, this high degree of exfiltration efficiency minimizes the amount of land required for a leach field. Where there is biomat buildup, solids settlement and resultant excess imperviousness occcur on the bottom plane of the leaching system. The present invention is particularly novel in that it allows for biomat buildup by having the greatest area of exfiltration surface on the vertical planes, i.e., on the exposed side surfaces of the cells. Also, since the cells allow placement of the filter materials within a closed form, the quantity of such material which must be trucked to a site and subsequently used is minimized.

The present invention also contemplates incorporating, at the point of cell array manufacture, a geotextile filtering fabric with the sheet material from which the cell arrays are fabricated. Such geotextile filter fabrics are known in the art and, for example, may be type EX-130 non-woven Geo-Textile fabric available from Exxon Chemical Corporation. By incorporating the geotextile filtering fabric with the sheet material from which the arrays are fabricated at the point of manufacture, the quantity of fabric required is minimized. The filtering fabric can be arranged such that it overlaps both the bottom and sides of the array of cells. However, the manufacture of the cell arrays is simplified by having the geotextile filtering fabric, if employed, on the sides of the cells only and, if necessary or desirable, placing a layer of the material at the bottom of the trench and/or over the top of the cells at the time of installation. When the geotextile filtering fabric is utilized, after the cell defining material degrades, the fabric is left to act as an interface between the stone filter and soil. The geotextile filtering fabric also contributes to the formation and subsequent maintenance of a biological mat.

Although the cellulose in the cardboard sheet materials is in itself a source of food for the biomat development, for added protection, and since the biodegradable cell-defining material is liquid absorbing and porous in nature, the material can be impregnated with an agent which promotes the growth and early development of the biological mat or crust. For example, in the preferred embodiment where the cell arrays are defined by corrugated cardboard, the cardboard may be impregnated a biological mat/crust promoting agent, such as a biologically compatible cardboard adhesive, and this agent can be employed with or without the geotextile filtering fabric.

In addition to the ability to choose the shape of the individual cells by controlling the degree of expansion of the cell array from its fully collapsed condition, it is to noted that the side panels can be made longer in the horizontal dimension than the divider panels 14. Also, if a particular application needs greater cell depth than afforded by a standard unit, the cell units can be stacked.

In one reduction of practice of the invention, the leach field defining cell arrays were fabricated from 275 pound C-type cardboard and defined a field section having eleven (11) individual cells, a total length of eighty eight (88) inches, and a depth of thirty (30) inches.

Figure 3:
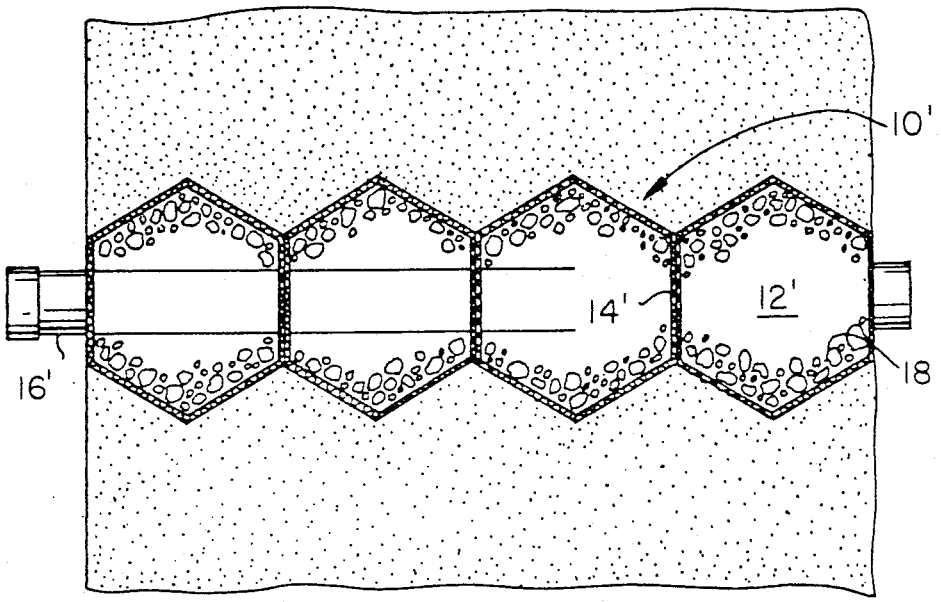
FIG. 3 is a cross-section view of a portion of a partially completed subterranean drain constructed in accordance with the present invention.
Figure 4:
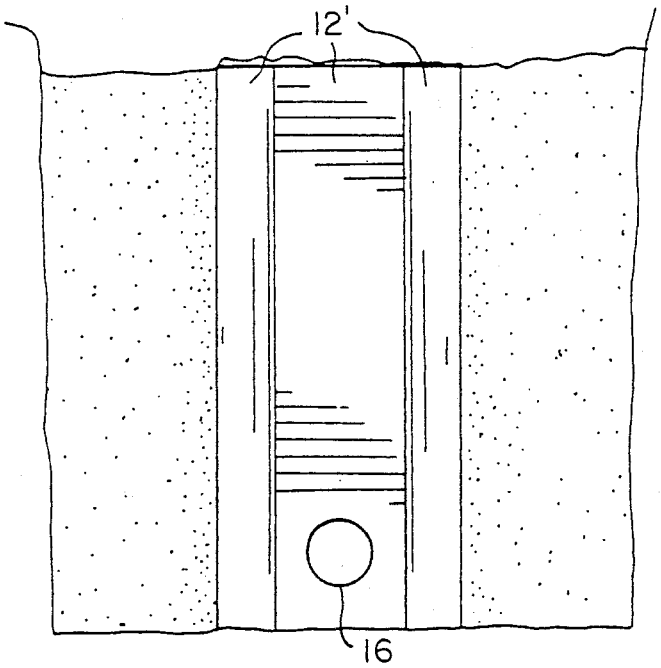
FIG. 4 is an end view of the drain of FIG. 3.

Referring now to FIGS. 3 and 4, the application of the invention to a drainage system, i.e., a system where the intended fluid flow is into the cells rather than out of the cells, is depicted. The arragement of FIGS. 3 and 4 is generally the same as that of FIGS. 1 and 2. However, in the embodiment of FIGS. 3 and 4 the arrays 11' are defined by individual cells 12' which are complete, i.e., closed on themselves, and each array is formed by bonding the individual cells to one another. This results in the dividing walls 14' between individual cells being double thickness as shown. The use of cell divider or partition walls of double thickness gives the array increased strength to side loading and thus permits the cells to be of greater depth. The individual cells are joined one to another by any suitable means such as use of a biodegradable adhesive, sewing, stapling, etc.

The embodiment of FIGS. 3 and 4 also differs from that of FIGS. 1 and 2 in that the holes which receive pipe 16' are adjacent the bottom of the cells rather than the top. It will be understood that a geotextile fabric can be employed in the subdrain application of FIGS. 3 and 4 to initially reinforce the sheet material and to prevent, particularly after the sheet material which defines the cells has degraded, silt infiltration. It will also be understood that in the subdrain application it may be desirable to incorporate, in the cell defining biodegradable material, an agent which promotes the degradation.

Figure 5:
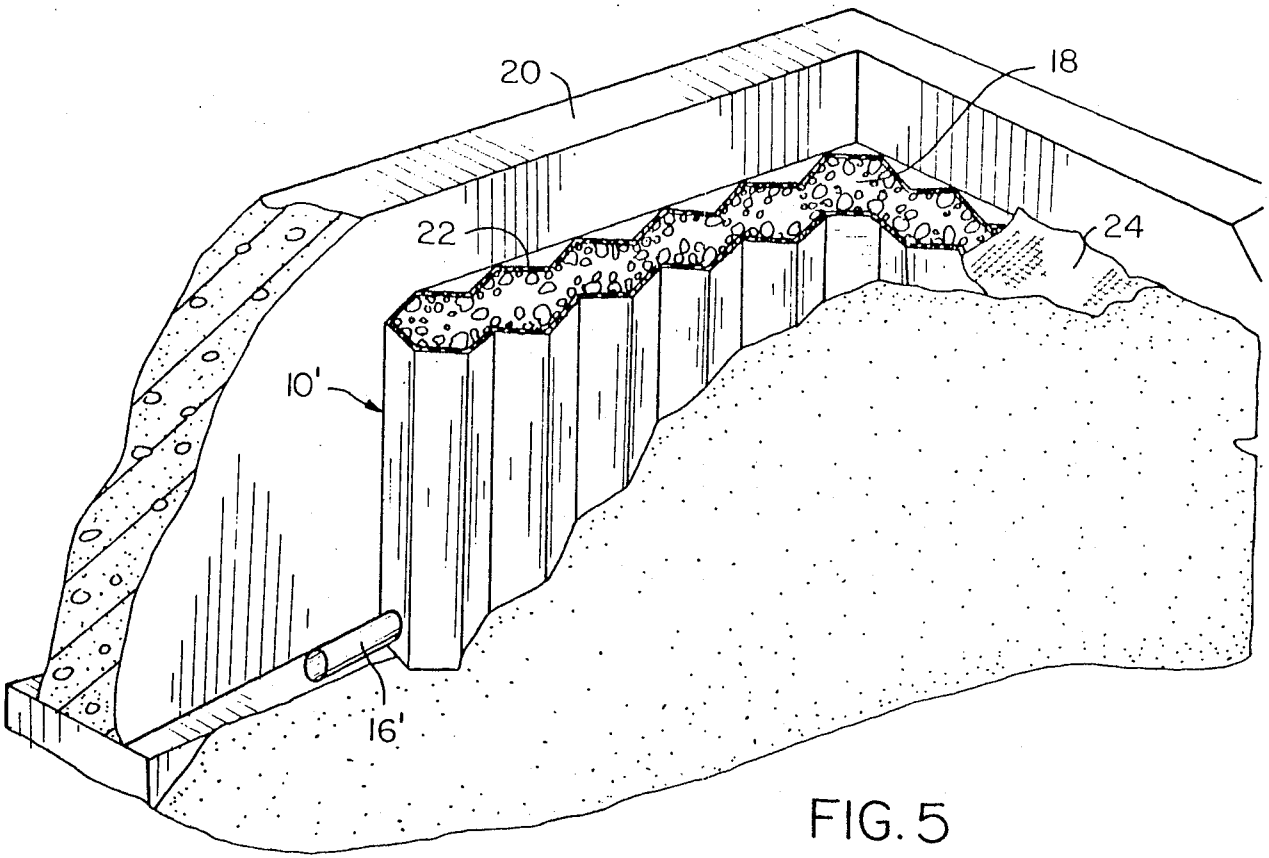
FIG. 5 is a perspective view of a modified form of the drain of FIGS. 3 and 4.

FIG. 5 depicts the present invention as it could be employed to direct liquid away from a wall 20. The cellular array configuration of either FIGS. 1 and 2 or FIGS. 3 and 4 can be employed in the FIG. 5 application. In the FIG. 5 embodiment, however, a fluid impervious sheet material 22 may be applied to the cellular array on the side which faces the wall. Also, as shown, the silt control fabric, discussed above and indicated at 24 in FIG. 5, may be employed on some or all of the top, bottom and outer side surface of the cellular array.

Figure 6:
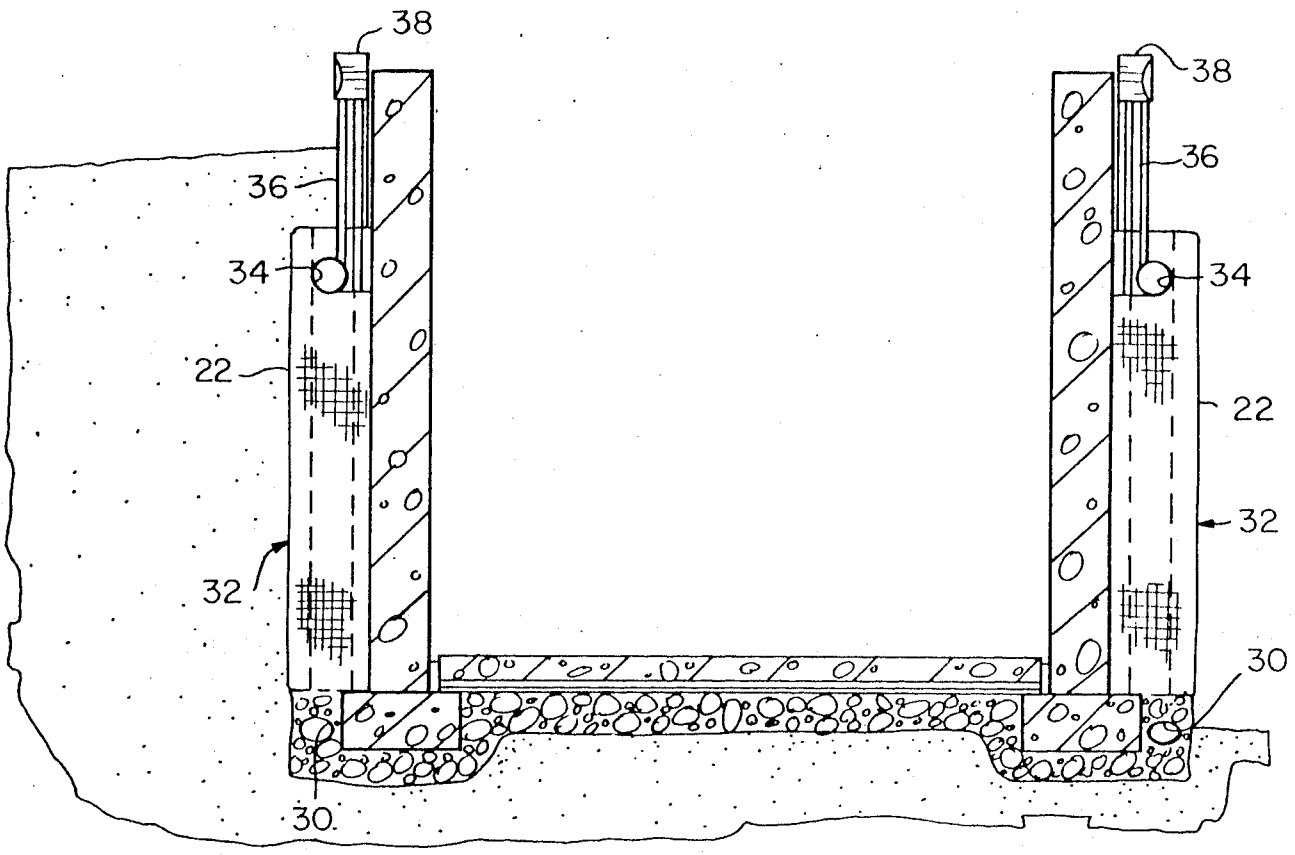
FIG. 6 is a schematic side-elevation view of a radon gas removal and moisture barrier system fabricated in accordance with the teachings of the present invention.

FIG. 6 depicts an end use similar to that of FIG. 5 but having the additional ability of venting radon gas from beneath a building foundation. In the FIG. 6 embodiment the foundation rests on a bed of crushed stone and conventional perforated drain tiles 30 are provided. Gas which is produced below the foundation, from decay of vegetation for example, will diffuse through the stone bed, flow into the drain tiles 30 and be vented upwardly through the cells of the drain system arrays of the present invention which are indicted at 32. Fluid communication between the interiors of the cells of the arrays which abut the foundation wall and the drain tiles will be through the gravel bed in which the drain tiles 30 are buried. The arrays of the present invention, in the FIG. 6 utilization, are provided with perforated drain pipes 34 adjacent their upper ends. The perforated pipes 34 are provided with cut-outs which communicate with vertically extending vent pipes 36, the vent pipes 36 being provided with caps 38 which prevent inflow of liquid.

While preferred embodiments have been shown and described, various modifications and substitutions may be made thereto without departing from the spirit and scope of the invention. Accordingly, the present invention has been described by way of illustration and not limitation.

What is claimed is:

1. Apparatus for defining a path for the flow of fluid comprising:

a three-dimensional collapsible cellular array, the array being defined by a series of multi-sided individual cells, said cells having a predetermined geometric shape and being open on at least one side whereby all the cells of the array may be filled with a material in particulate form when the array is in the expanded use state, sides of said cells being defined by walls which each have a predetermined size and shape in the unstressed condition, the serial array of cells including a pair of end cells and a plurality of intermediate cells, said array being formed from a fluid pervious material and adjacent cells of the array being separated by dividing walls; and means for establishing a flow path through all of the cells of the serial array, said flow path establishing means extending through the dividing walls between adjacent cells of the array.

2. The apparatus of claim 1 wherein said flow path establishing means comprises a perforated conduit whereby fluid can be exchanged between the interior of the cells of the array.

3. The apparatus of claim 1 wherein the individual cells of said array are open at a pair of opposite sides and said array is formed from a biodegradable material.

4. The apparatus of claim 1 further comprising a fluid impervious material in particulate form in said cells, said material in particulate form permitting fluid flow between the exterior of the cells and the conduit via the interstices between particles and the cell sides.

5. The apparatus of claim 2 wherein the individual cells of said array are open at a pair of opposite sides and said array is formed from a biodegradable material.

6. The apparatus of claim 5 further comprising a fluid impervious material in particulate form in said cells, said material in particulate form permitting fluid flow between the exterior of the cells and the conduit via the interstices between particles and the cell sides.

7. The apparatus of claim 1 further comprising a textile filter material which extends over at least part of at least one side of each cell of said array.

8. The apparatus of claim 4 further comprising a textile filter material which extends over at least part of at least one side of each cell of said array.

9. The apparatus of claim 6 further comprising a textile filter material which extends over at least part of at least one side of each cell of said array.

10. The apparatus of claim 3 wherein the individual cells are of hexagonal cross-sectional shape and have a predetermined depth, said open sides being generally parallel and separated by the said predetermined depth.

11. The apparatus of claim 10 further comprising a fluid impervious material in particulate form in said cells, said material in particulate form permitting fluid flow between the exterior of the cells and the conduit via the interstices between particles and the cell sides.

12. The apparatus of claim 11 wherein said flow path establishing means comprises a perforated conduit whereby fluid can be exchanged between the interior of the cells of the array.

13. The apparatus of claim 12 further comprising a textile filter material which extends over at least part of at least one side of each cell of said array.

14. The apparatus of claim 2 wherein said flow path establishing means includes conduit receiving cut-outs in the said dividing walls, said cut-outs being located in said dividing walls so as to impart a predetermined pitch to the conduit from one end of said array to the opposite end thereof.

15. The apparatus of claim 13 wherein said flow path establishing means includes conduit receiving cut-outs in the said dividing walls, said cut-outs being located in said dividing walls so as to impart a predetermined pitch to the conduit from one end of said array to the opposite end thereof.

16. The apparatus of claim 3 wherein said biodegradable material is cardboard.

17. The apparatus of claim 10 wherein said biodegradable material is cardboard.

18. The apparatus of claim 12 wherein said biodegradable material is cardboard.

* * * * *